US009352942B1

(12) United States Patent
Genier

(10) Patent No.: US 9,352,942 B1
(45) Date of Patent: May 31, 2016

(54) AXLE JACK

(71) Applicant: Mario A. Genier, Fort McMurry (CA)

(72) Inventor: Mario A. Genier, Fort McMurry (CA)

( * ) Notice: Subject to any disclaimer, the term of this patent is extended or adjusted under 35 U.S.C. 154(b) by 204 days.

(21) Appl. No.: 14/270,136

(22) Filed: May 5, 2014

(51) Int. Cl.
*B66F 3/00* (2006.01)

(52) U.S. Cl.
CPC ..... *B66F 3/005* (2013.01)

(58) Field of Classification Search
CPC ..... B66F 3/006; B66F 1/00; B66F 3/005; B66F 7/12; B66F 7/243; B66F 2700/05
See application file for complete search history.

(56) References Cited

U.S. PATENT DOCUMENTS 2,001,467 A 5/1935 Madigan
5,039,070 A * 8/1991 Warner ..... B66F 3/005 254/94
5,228,651 A * 7/1993 Warner ..... B66F 3/005 254/94
5,441,237 A * 8/1995 Sweeney ..... B66F 3/35 254/93 HP
6,053,477 A * 4/2000 Price ..... B66F 3/005 254/94
6,231,081 B1 * 5/2001 Berke ..... B60S 9/02 254/419
7,472,889 B1 * 1/2009 Prather ..... B66F 3/16 254/103

* cited by examiner

*Primary Examiner* — Lee D Wilson
(74) *Attorney, Agent, or Firm* — Crossley & Stevenson IP Law

(57) ABSTRACT

An axle jack includes a support column extending along a longitudinal axis between a top end and a base end. An axle plate is coupled to the top end of the support column and a base plate including an upper surface and a lower surface is coupled to the support column base end. One or more gussets are arranged between the base plate upper surface and the support column and a handle projects from the support column at a position intermediate the top and base ends of the support column. Gripping protrusions are formed on the lower surface of the base plate.

10 Claims, 6 Drawing Sheets

AXLE JACK

BACKGROUND

Wheeled vehicles occasionally require maintenance or replacement of tires, wheels, breaks and suspension components. Various types of jacks are used to jack up or elevate a vehicle or a region of a vehicle for these operations.

Known jacks suffer from a variety of shortcomings. For example, hydraulic jacks which are commonly used with large or heavy vehicles are unstable when supporting a vehicle and are susceptible to freezing in cold environments. Other jack types are also unstable while supporting a vehicle and lack handles, are heavy or require lubricant for moving parts. Many of these shortcomings represent a risk of injury to their operators.

SUMMARY

An axle jack includes a support column having a top end and a base end. The support column extends along a longtidinal axis. An axle plate is coupled to the top end of the support column and a base plate including an upper surface and a lower surface is coupled to the support column base end. At least one gusset is arranged between the base plate upper surface and the support column. A handle projects from the support column at a position intermediate the top and base ends of the support column. Reflective tape is coupled with the support column at one or more positions intermediate the top and base ends of the support column. Gripping protrusions are formed on the lower surface of the base plate.

According to a method for elevating and supporting a vehicle on a supporting surface a flat base plate is provided with a forward edge, a rearward edge, an upper surface and a lower surface. A support column having a longitudinal axis is mounted to the base plate upper surface and an axle plate is coupled to the support column distal from the base plate.

DETAILED DESCRIPTION

Figure 1:
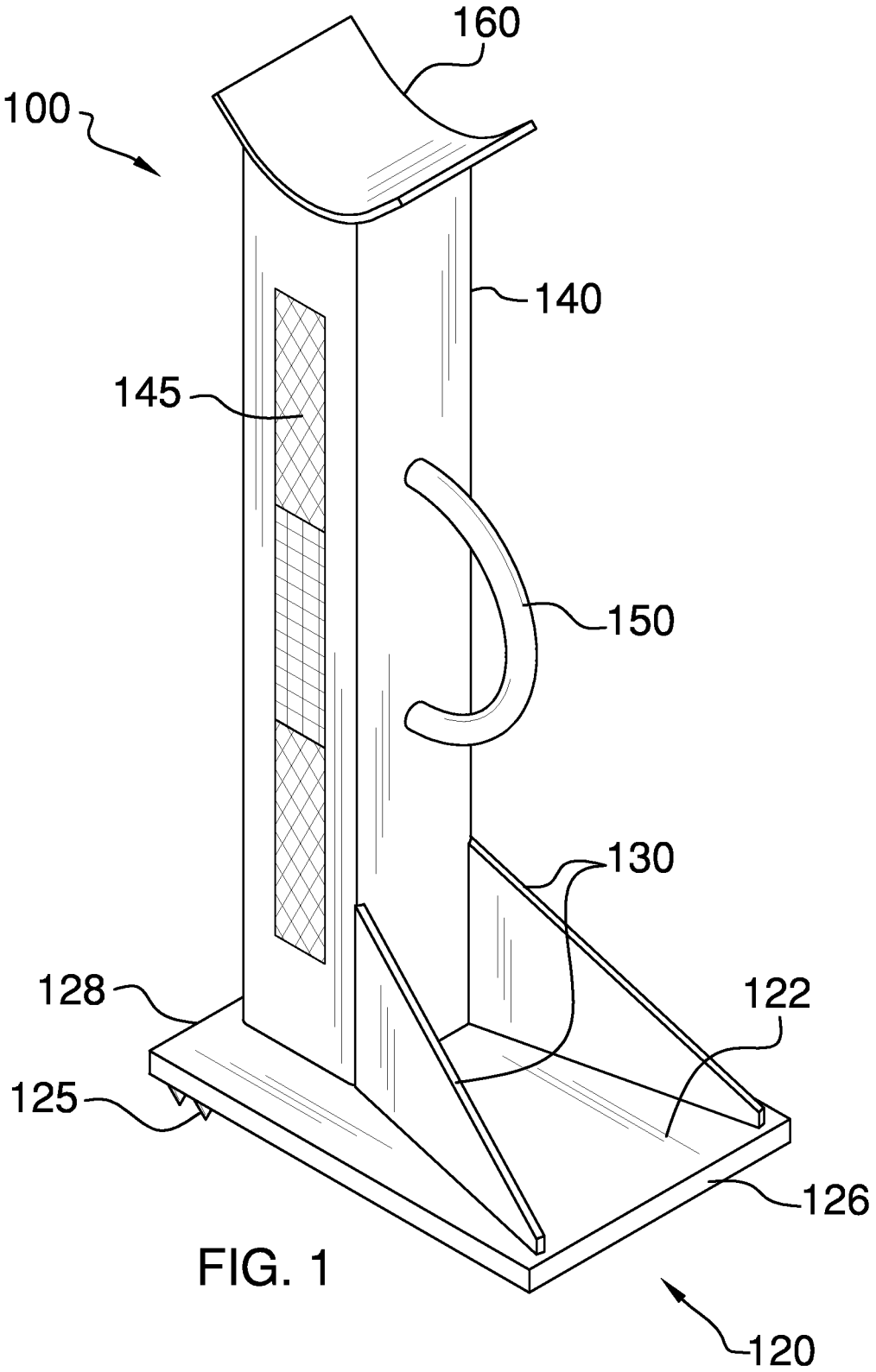
FIG. 1 illustrates a top perspective view of an example axle jack.

With reference now to the FIGS. 1-6 a new axle jack for use to elevate and support vehicle axles and generally designated by the reference numeral 100 will now be described.

FIG. 1 illustrates a top perspective view of an example axle jack 100. Axle jack 100 includes a base plate 120 having an upper surface 122 with a center, a lower surface 124, a forward edge 126 and a rearward edge 128. While base plate 120 may take any of a variety of shapes and may assume any of a variety of contours, in one example, lower surface 124 of base plate 120 is flat such that the lower surface lies substantially within a single plane.

Figure 2:
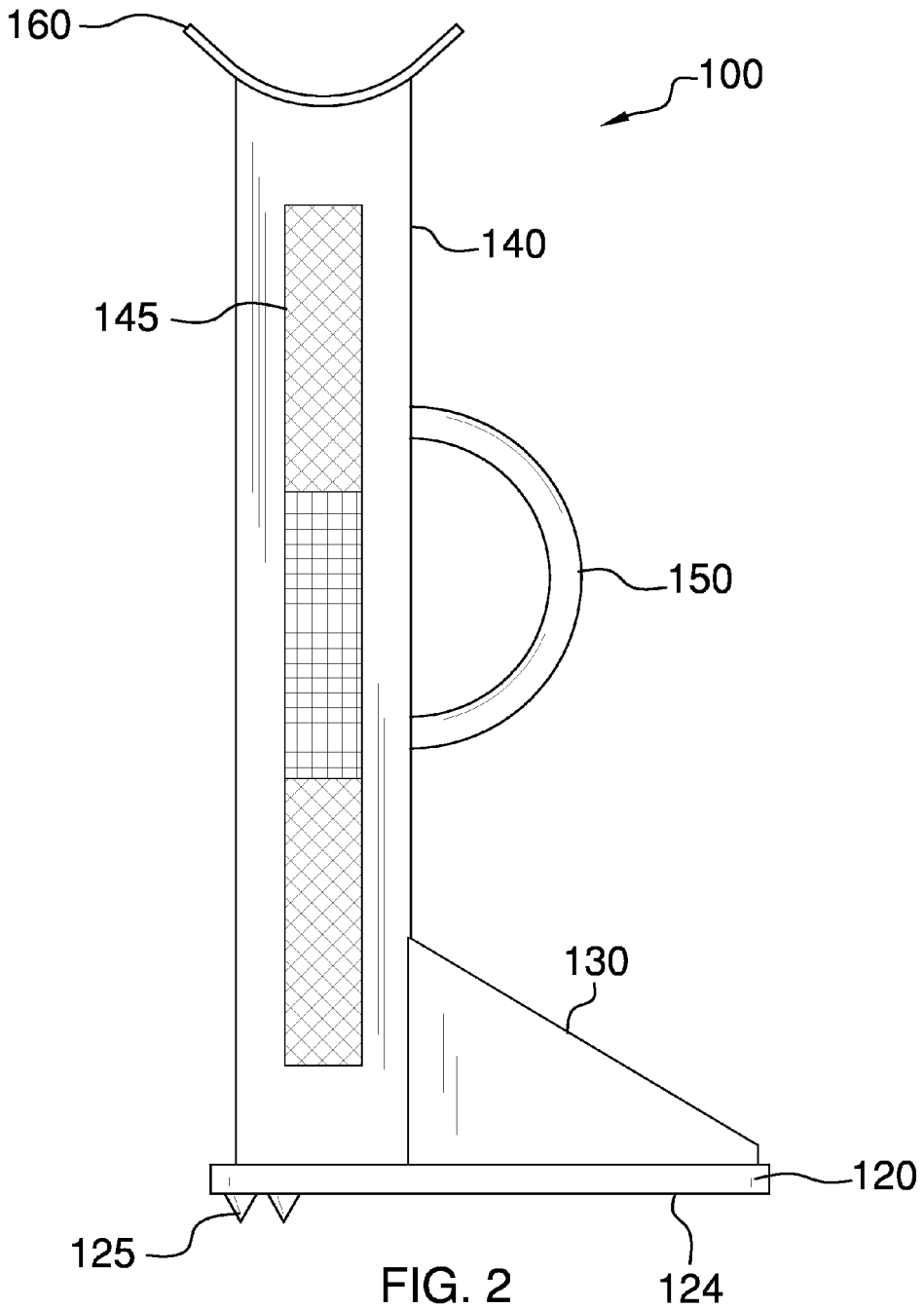
FIG. 2 illustrates a side view of an example axle jack.
Figure 3:
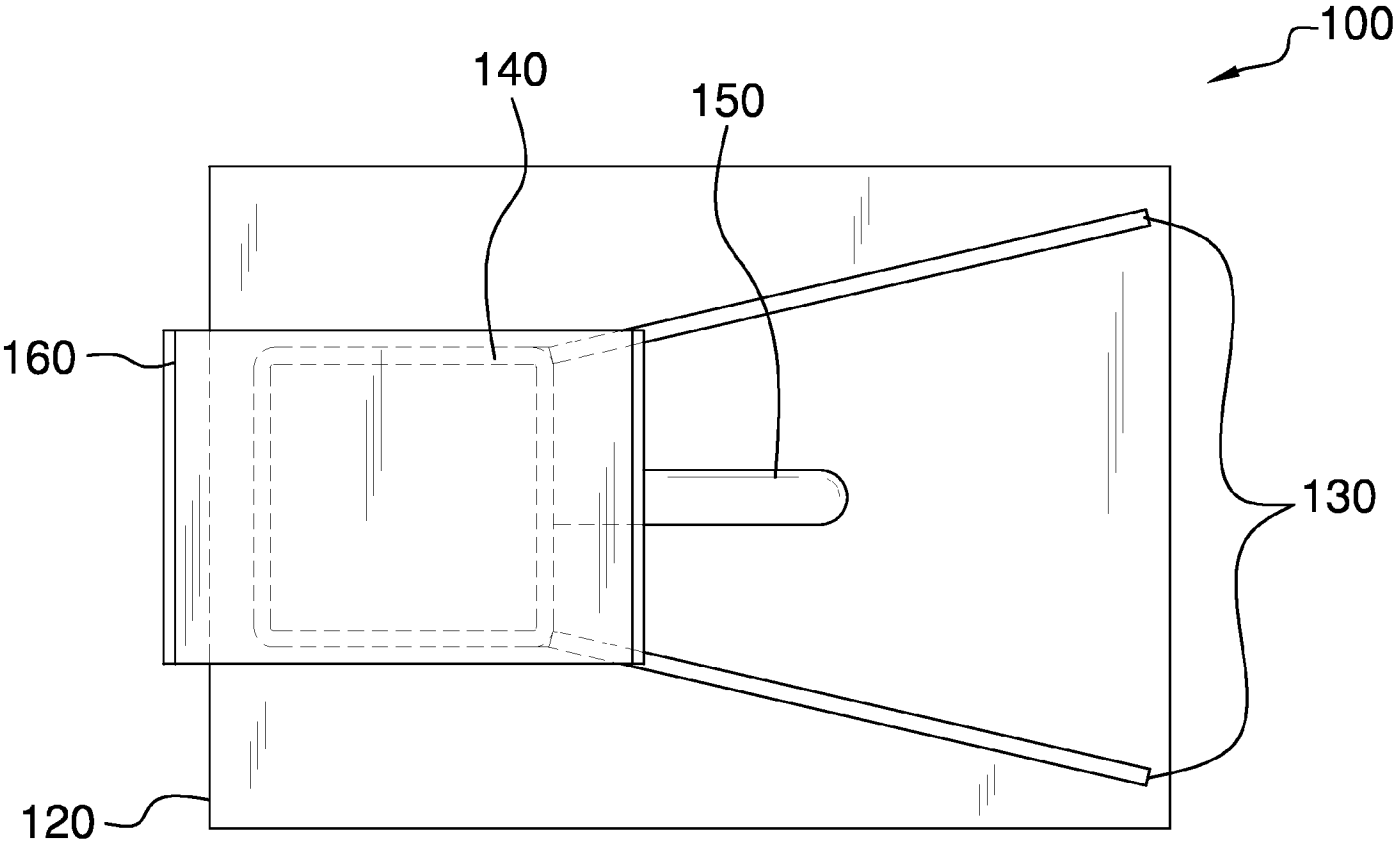
FIG. 3 illustrates a top view of an example axle jack.

A support column 140 having a longitudinal axis extending between top and base ends, is mounted to base plate upper surface 122 near base plate rearward edge 128 and distal from base plate forward edge 126 (FIGS. 1-3). With support column 140 mounted away from the center of the upper surface of base plate 120, base plate 120 extends away from support column 140 a greater distance in a first direction along a transverse axis than in a second, opposite direction along the transverse axis (FIG. 2). Therefore, jack 100 is more resistant to tipping towards the first direction than towards the second direction.

Reflective tape 145 may be affixed to support column 140 at one or more positions intermediate the top and base ends.

Two gussets 130 extend between base plate upper surface 122 near base plate forward edge 126 and support column 140. Gussets 130 angle away from one another adjacent to base portion forward edge 126 (FIG. 3). The angle assumed may vary depending on the rigidity desired between support column 140 and base plate 120. For example, the angle between gussets 130 may be approximately 30 degrees.

A handle 150 is mounted to support column 140 and extends or projects toward base plate forward edge 126. While any of a variety of structures may be used to provide a handle, in one example, handle 150 forms a loop. Furthermore, handle 150 may be placed at any position between the top and base ends of support column 140. In an alternative example, handle 150 may be provided so as to project toward base plate rearward edge 128.

An axle plate 160 is mounted to support column 140 at a top end distal from base plate 120 and includes a shape configured to cup and support a vehicle axle. In one example, axle plate 160 includes a concave support surface (FIG. 2). In another example (not depicted), the axle support surface comprises an open-rectangular shape.

Figure 4:
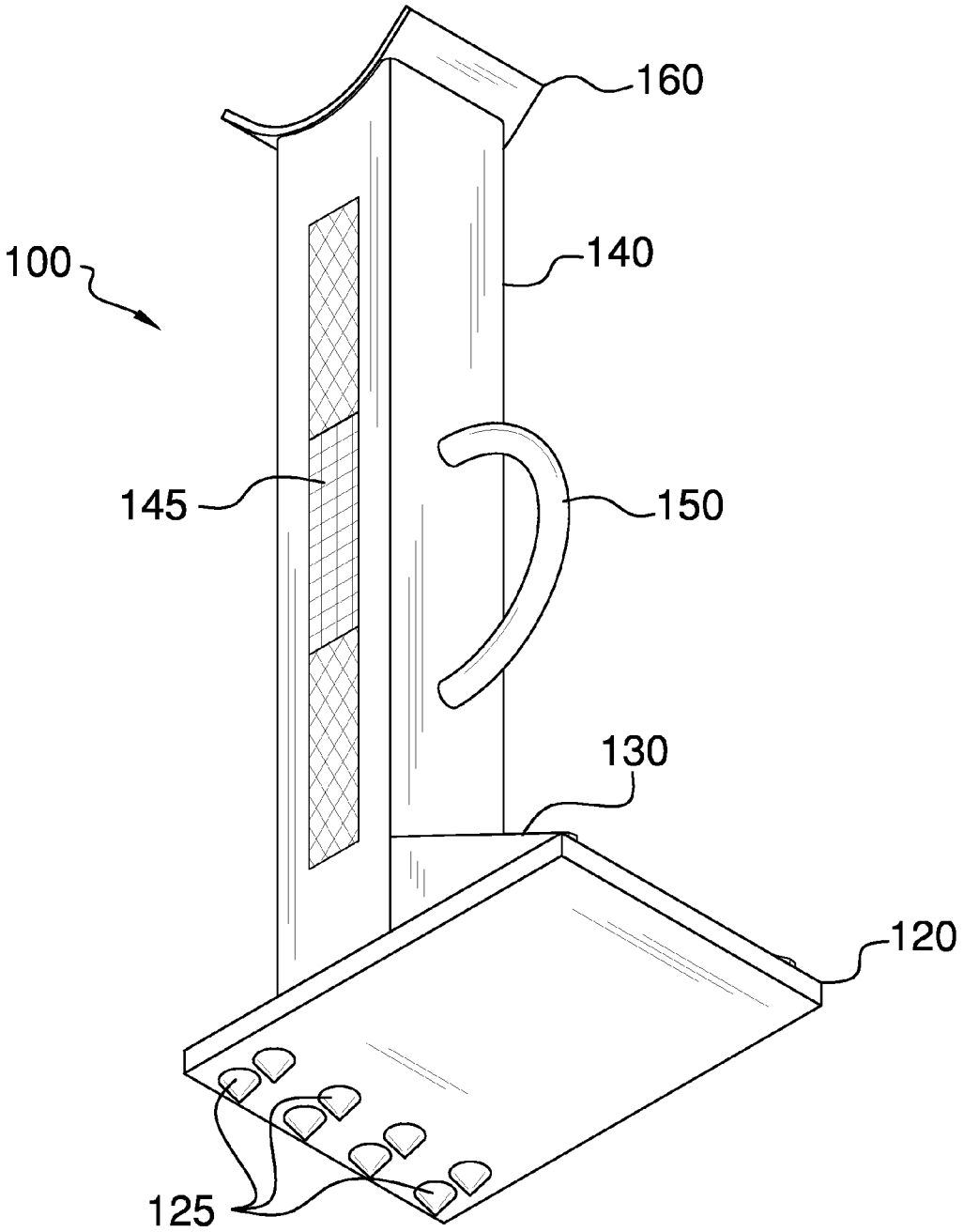
FIG. 4 illustrates a bottom perspective view of an example axle jack.

FIG. 4 illustrates a bottom perspective view of an example axle jack 100. A number of gripping protrusions 125 are formed on base plate lower surface 124. Gripping protrusions may be formed as teeth or ridges (not shown).

In another example axle jack (not shown), an axle plate is configured to move toward and away from a base plate. This movement may be enabled by relative translation of top and base ends of a support column. A support column lower portion includes a base plate having an upper surface and a lower surface and is configured to receive, in a telescoping manner, a number of support column upper portions each including a variety of axle plate.

One example method for elevating and supporting a vehicle axle in accordance with the present disclosure includes manufacturing or assembling an axle jack. In assembly, a flat base plate is provided with a forward edge, a rearward edge, an upper surface with a center and a lower surface and a support column having a longitudinal axis is mounted to the base plate upper surface away from the center. An axle plate is coupled to the support column distal from the base plate. Mountings and couplings may be secured by welding, for example.

Additional utilities and advantages may be achieved by arranging at least one gusset between the base plate and the support column; providing a handle protruding from the support column at one or more positions intermediate the top and base ends of the support column, affixing or otherwise supplying reflective tape to the support column at one or more positions intermediate the top and base ends of the support column and forming one or more gripping protrusions on the lower surface of the base plate.

Figure 5:
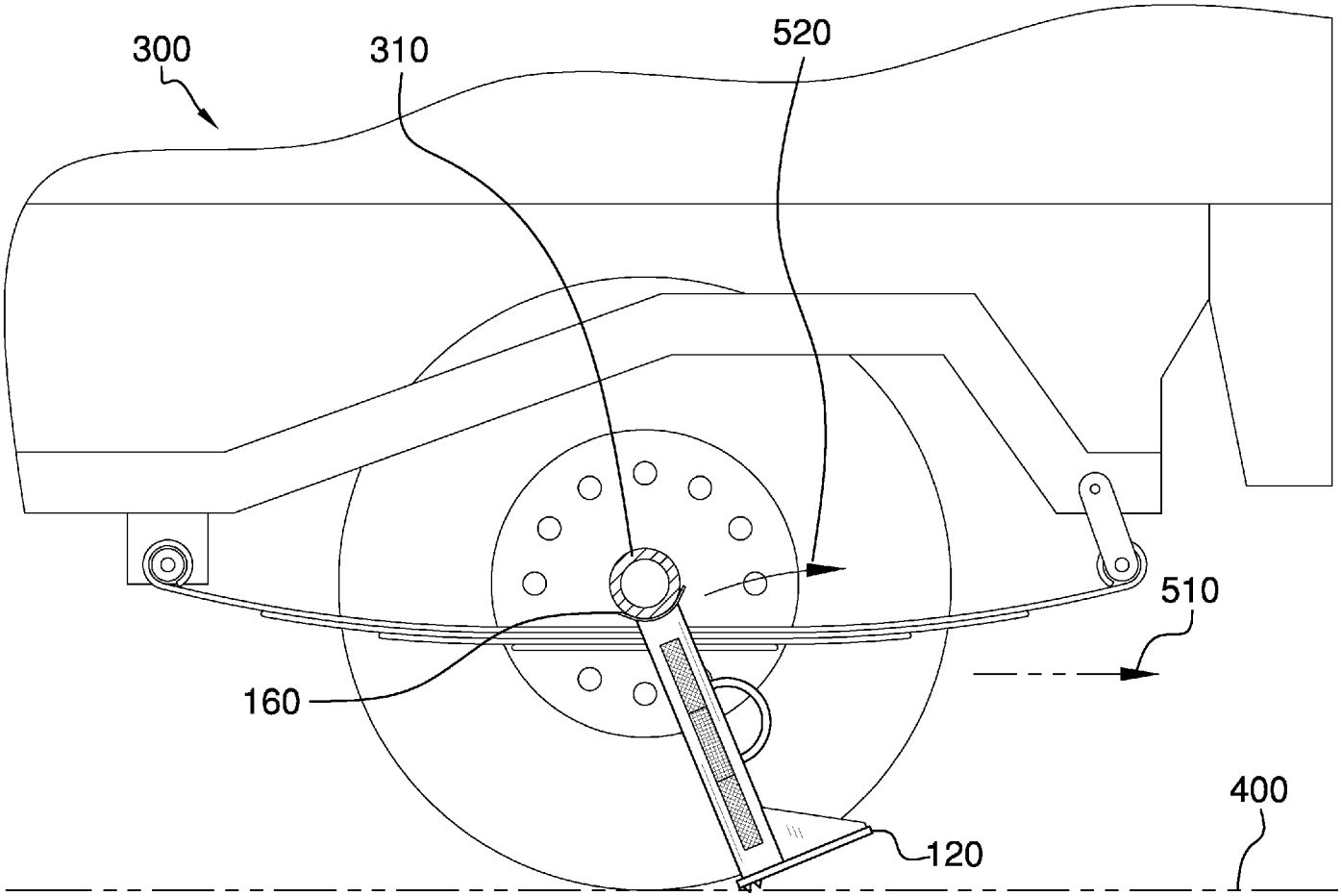
FIG. 5 illustrates an example axle jack being operated to elevate an example vehicle axle.

An assembled axle jack may be used in a method to elevate and support a vehicle axle, for example during vehicle servicing. FIG. 5 illustrates an example axle jack 100 being operated to elevate a vehicle axle 310 of example vehicle 300. With axle plate 160 cupping vehicle axle 310 base plate 120 is placed on a vehicle supporting surface 400 with a support column longitudinal axis oriented at an oblique angle such that it is between vertical and horizontal (FIG. 5). With axle plate 160 in contact with vehicle axle 310 and with base plate 120 in contact with vehicle supporting surface 400, vehicle 300 and thereby vehicle axle 310 is moved in a first direction designated by arrow 510. This forward movement serves to vertically orient the support column longitudinal axis with a tilting or pivoting motion designated by arrow 520. With axle jack 100 in a vertical orientation, axle 310 is supported in an elevated position and a vehicle tire may be replaced or brakes or suspension may be serviced.

Once the tire has been replaced or other service has been performed, vehicle 300, and thereby axle 310, is moved in a second direction opposite the first direction to re-orient the support column longitudinal axis at the oblique angle so that it may be removed.

Figure 6:
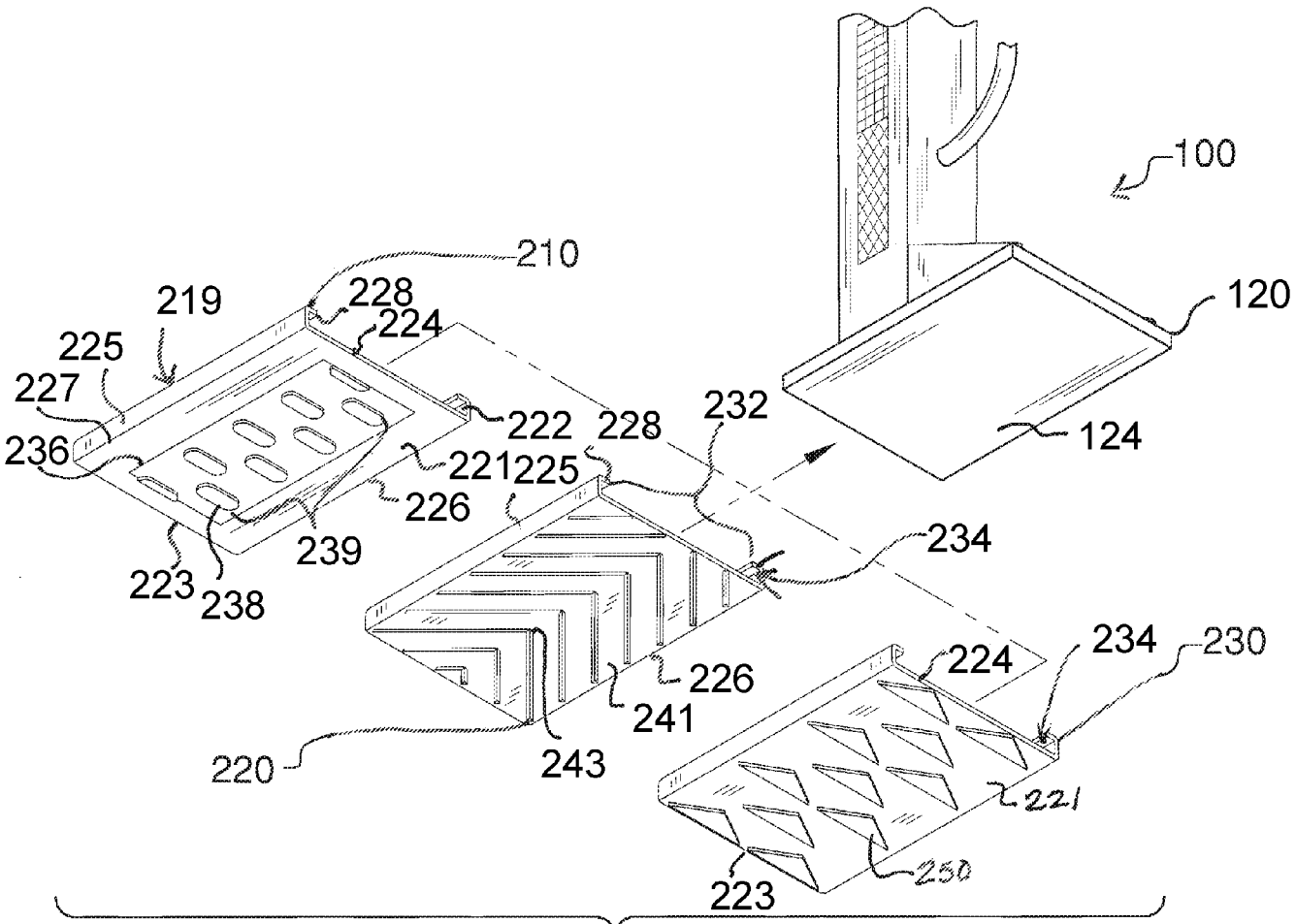
FIG. 6 illustrates perspective views of a variety of example interchangeable treads usable with an example axle jack.

In an example, axle jack 100 may be part of a kit including a number of treads 219 configured for removable, slidable assembly to the base plate lower surface. Each of the treads 219 has a width, a length, and a depth configured to securingly conform to a width, a length and a depth of the base plate 120. Each of the treads 219 includes an exterior surface 221, an interior surface 222, a rear wall 223, a front edge 224 of the exterior surface 221, a right wall 225, and a left wall 226 spaced apart from the right wall 225. The front edge 224 is spaced apart from the rear wall 223. Each of the right wall 225 and the left wall 226 is continuously disposed between the front edge 224 and the rear wall 223 and has a continuous external edge 227. A lip 228 is continuously disposed along the external edge 227 in a position parallel to the interior surface 222. Each of the left wall 226 and the right wall 225 has a height substantially equal to a height of the base plate 120, except when the lower surface 124 of the base plate 120 includes the gripping protrusions 125 in which case the height of each of the left wall 226 and the right wall 225 is substantially equal to a collective height of the base plate 120 and a height of a tallest one of the gripping protrusions 125. A gap 232 is disposed between the lip 228 of the right wall 225 and the lip 228 of the left wall 226. The gap 232 and the lip 228 of each of the right wall 225 and the left wall 226 have a total combined width substantially equal to the width of the base plate 120. Each tread 219 also includes a receiving channel 234 defined by the right wall 225, the left wall 226, the lip 228 of each of the right wall 225 and the left wall 226, and the interior surface 222. The receiving channel 234 has a width, a length, and a depth substantially equal to the width, the length, and the depth of the base plate 120 and slidingly engages the base plate 120. Upon the sliding engagement of the receiving channel 234 to the base plate 120, the interior surface 222 of the tread 219 is directly adjacent the lower surface 124 of the base plate 120 except, of course, in the instance of the gripping protrusions 125, as shown in FIG. 4, on the base plate 120 in which case the receiving channel 234 has a depth substantially equal to a combined depth of the depth of the base plate 120 and a depth of the tallest one of the gripping protrusions 125 and the interior surface 222 is parallel to and proximal the lower surface 124. FIG. 6 illustrates perspective views of a variety of example interchangeable treads usable with an example axle jack. Example first tread 210 includes a closed elliptical pattern, example second tread 220 includes a chevron pattern and example third tread 230 includes a closed wedge pattern. The exterior surface 221 of the first tread 210 has a center portion 236 centrally disposed between the rear wall 223, the front edge 224, the right wall 225, and the left wall 226. The center portion 236 includes a plurality of obround humps 238 arranged in a pair of rows 239. The humps 238 of one of the rows 239 are off-set from the humps 239 in the other row 239. The exterior surface 221 of the second tread 220 has a plurality of V-shaped protuberances 241. Substantially all of the protuberances 241 have an apex 243. The apices 243 are centrally aligned from the front edge 224 to the rear wall 223. The protuberances 241 are disposed on the entire exterior surface 221 of the second tread 220. The exterior surface 221 of the third tread 230 has a plurality of triangular bumps 250 disposed on the entire exterior surface 221. The bumps 250 are arranged in alternating configuration of a pair of the bumps 250 alternating with a single one of the bumps 250 from the front edge 224 to the rear wall 223.

Axle jack 100 may be constructed from any of a variety of lightweight, durable materials including but not limited to one or more metals. For example, jack 100 may be constructed from steel, aluminum, titanium or a combination of these. In other examples, axle jack 100 may be constructed from one or more carbon composites.

Axle jack 100 may be constructed to any of a variety of dimensions suitable for wedging of jack 100 under a vehicle axle in a first orientation and elevating the vehicle axle in a second, vertical orientation. In an example, jack 100 may measure between approximately 0.3 m and approximately 1 m between base plate 120 and axle plate 160; base plate 120 may measure between approximately 0.25 m and approximately 0.35 m long and between approximately 0.12 m and approximately 0.25 m wide; and support column 140 may include a rectangular cross section measuring between approximately 5 cm and approximately 10 cm long and between approximately 3 cm and approximately 10 cm wide.

While the above descriptions have been presented with respect to certain specific embodiments, it will be appreciated that many modifications and changes may be made by those skilled in the art without departing from the spirit and scope of the disclosure. It is intended, therefore, by the appended claims to cover all such modifications and changes as fall within the true spirit and scope of the disclosure.

What is claimed is:

1. An axle jack, comprising:

a base plate having an upper surface, a lower surface, a forward edge and a rearward edge;

a support column mounted to the base plate upper surface near the base plate rearward edge, distal from the base plate forward edge;

an axle plate mounted to the support column distal from the base plate;

a plurality of treads configured for removable assembly to the base plate lower surface, each of the treads having a width, a length, and a depth configured to securingly conform to a width, a length and a depth of the base plate, each of the treads comprising:

an exterior surface;

an interior surface;

a rear wall a front edge of the exterior surface, the front edge spaced apart from the rear wall;

a right wall;

a left wall spaced apart from the right wall, each of the right wall and the left wall continuously disposed between the front edge and the rear wall, each of the right wall and the left wall having a continuous external edge and a lip continuously disposed along the external edge in a position parallel to the interior surface, wherein each of the left wall and the right wall has a height substantially equal to a height of the base plate;

a gap between the lip of the right wall and the lip of the left wall, wherein the gap and the lip of each of the right wall and the left wall have a total combined width substantially equal to the width of the base plate; and a receiving channel defined by the right wall, the left wall, the lip of each of the right wall and the left wall, and the interior surface;

wherein the receiving channel has a width, a length, and a depth substantially equal to the width, the length, and the depth of the base plate;

wherein the receiving channel slidingly engages the base plate;

wherein upon the sliding engagement of the receiving channel to the base plate, the interior surface of the tread is directly adjacent the lower surface of the base plate;

wherein the plurality of treads comprising a first tread, a second tread, and a third tread;

wherein the exterior surface of the first tread comprises a center portion centrally disposed between the rear wall, the front edge, the right wall, and the left wall, the center portion comprising a plurality of obround humps arranged in a pair of rows, the humps of one of the rows being off-set from the humps in the other row;

wherein the exterior surface of the second tread comprises a plurality of V-shaped protuberances, wherein substantially all of the protuberances have an apex, wherein the apices are centrally aligned from the front edge to the rear wall, wherein the protuberances are disposed on the entire exterior surface of the second tread; and wherein the exterior surface of the third tread comprising a plurality of triangular bumps disposed on the entire exterior surface, wherein the bumps are arranged in alternating configuration of a pair of the bumps alternating with a single one of the bumps from the front edge to the rear wall.

2. The axle jack as set forth in claim 1 wherein the jack is more resistant to tipping in a first direction than in a second direction opposite the first direction.

3. The axle jack as set forth in claim 1 further comprising a handle mounted to the support column and extending toward the base plate forward edge.

4. The axle jack as set forth in claim 1 wherein the axle plate further comprises an axle support surface.

5. The axle jack as set forth in claim 4 wherein the axle support surface comprises a concave shape configured to cup a vehicle axle.

6. An axle jack, comprising:

a support column having a top end and a base end, the support column extending along a longtidinal axis;

an axle plate coupled to the top end of the support column;

a base plate coupled to the base end of the support column, the base plate including an upper surface and a lower surface;

at least one gusset arranged between the base plate upper surface and the support column;

a handle projecting from the support column at a position intermediate the top and base ends of the support column;

a reflective tape coupled with the support column at one or more positions intermediate the top and base ends of the support column;

a plurality of gripping protrusions formed on the lower surface of the base plate;

a plurality of treads configured for removable assembly to the base plate lower surface, each of the treads having a width, a length, and a depth configured to securingly conform to a width, a length and a depth of the base plate, each of the treads comprising:

an exterior surface;

an interior surface;

a rear wall a front edge of the exterior surface, the front edge spaced apart from the rear wall;

a right wall;

a left wall spaced apart from the right wall, each of the right wall and the left wall continuously disposed between the front edge and the rear wall, each of the right wall and the left wall having a continuous external edge and a lip continuously disposed along the external edge in a position parallel to the interior surface, wherein each of the left wall and the right wall has a height substantially equal to a collective height of the base plate and a height of a tallest one of the gripping protrusions;

a gap between the lip of the right wall and the lip of the left wall, wherein the gap and the lip of each of the right wall and the left wall have a total combined width substantially equal to the width of the base plate; and a receiving channel defined by the right wall, the left wall, the lip of each of the right wall and the left wall, and the interior surface;

wherein the receiving channel has a width, a length, and a depth substantially equal to the width, the length, and a combined depth of the depth of the base plate and a depth of the tallest one of the gripping protrusions on the lower surface;

wherein the receiving channel slidingly engages the base plate;

wherein upon the sliding engagement of the receiving channel to the base plate, the interior surface of the tread is parallel to and proximal the lower surface of the base plate;

wherein the plurality of treads comprising a first tread, a second tread, and a third tread;

wherein the exterior surface of the first tread comprises a center portion centrally disposed between the rear wall, the front edge, the right wall, and the left wall, the center portion comprising a plurality of obround humps arranged in a pair of rows, the humps of one of the rows being off-set from the humps in the other row;

wherein the exterior surface of the second tread comprises a plurality of V-shaped protuberances, wherein substantially all of the protuberances have an apex, wherein the apices are centrally aligned from the front edge to the rear wall, wherein the protuberances are disposed on the entire exterior surface of the second tread; and wherein the exterior surface of the third tread comprising a plurality of triangular bumps disposed on the entire exterior surface, wherein the bumps are arranged in alternating configuration of a pair of the bumps alternating with a single one of the bumps from the front edge to the rear wall.

7. The axle jack as set forth in claim 6 wherein the handle forms a loop.

8. The axle jack as set forth in claim 6 wherein the gripping protrusions are formed as gripping teeth.

9. The axle jack as set forth in claim 6 wherein the base plate extends away from the support column a greater distance in a first direction transverse to the longitudinal axis than in a second, opposite transverse direction.

10. The axle jack as set forth in claim 6 wherein the base plate lower surface lies substantially within a single plane.

* * * * *